United States Patent [19]

Loos

[11] Patent Number: 4,475,927

[45] Date of Patent: Oct. 9, 1984

[54] BIPOLAR FOG ABATEMENT SYSTEM

[76] Inventor: Hendricus G. Loos, 3019 Cresta Way, Laguna Beach, Calif. 92651

[21] Appl. No.: 239,893

[22] Filed: Mar. 3, 1981

[51] Int. Cl.[3] ..... B03C 1/00

[52] U.S. Cl. ..... 55/10; 55/107; 55/122; 55/DIG. 25; 361/228; 361/231; 239/2 R; 239/3; 239/14; 239/692; 239/695

[58] Field of Search ..... 361/226-228, 361/231; 55/5, 10, 107, 122, DIG. 25; 239/3, 692, 695, 14, 2 R, 690; 98/1

[56] References Cited

U.S. PATENT DOCUMENTS

| | | | |
|---|---|---|---|
| 2,881,335 | 4/1959 | Vonnegut | 361/226 |
| 3,131,131 | 4/1964 | Wehner | 239/690 |
| 3,712,542 | 1/1973 | Price, Jr. | 239/2 R |
| 3,757,491 | 9/1973 | Gourdine | 55/107 |
| 3,958,959 | 5/1976 | Cohen et al. | 55/10 |
| 4,162,144 | 7/1979 | Cheney | 55/2 |

OTHER PUBLICATIONS

Ruhnke, Warm Fog Modification by Seeding with Unipolar Ions, Atmospheric Physics & Chem. Laboratory, ESSA Research Lab Environmental Science Service Administration, Boulder, Colorado, 4/1970, pp. 385-388 and (Figures).

Carroz and Keller, "Electrostatic Induction Parameters to Attain Maximum Spray Charge to Clear Fog", Naval Weapons Center TP 5796.

Clark et al., "Project Foggy Cloud V", Naval Weapons Center TP 5542 (1973).

Ruhnke, "Warm Fog Modification by Seeding with Unipolar Ions", AMS 2nd Nat. Conf. Weather Mod., Apr. 1970, Santa Barbara, CA.

Gourdine et al., "EGD Fog Dispersal System Scaling Laws", 4th AMS Nat. Conf. Weather Mod., Nov. 1974, Ft. Lauderdale, Florida (1974).

Chiang et al., "Field Evaluation of an Electrogasdynamic Fog Dispersal Concept", FAA Report FAA-R-D-73-33 (1973).

Whipple and Chalmers, Quart. Journal R. Met. Soc., 70, 103 (1944).

Loveland et al., "Project Foggy Cloud IV", Naval Weapons Center TP 5338 (1972).

Schlichting, "Boundary-Layer Theory", pp. 696-698, McGraw-Hill, New York, 1968.

*Primary Examiner*—Bernard Nozick

[57] ABSTRACT

A method and system for the abatement of fog in a designated air space over an aircraft approach zone and runway, consisting of gapped air jets laden with electrically charged droplets of low mobility, a ground corona guard in the form of a shallow water-and-oil basin, and a charged-collector-drops emitting device on the ground, arranged in such a manner that the low-mobility charged droplets blown aloft by the air jets form a virtual electrode suspended at appropriate height above the ground, toward which the oppositely charged high-mobility collector drops move, thereby collecting the neutral fog drops in their paths. The perforation ratio of the gapped air jet array is chosen such that the wind flux which penetrates the jet array is substantially equal to the entrainment flux at the lee side of the jets, thereby providing for a virtual canopy over the spatial region in which the fog is to be abated. A corona guard prevents neutralization of the collective electric field set up by the charged droplets blown aloft by the air jets, and also prevents premature neutralization of these droplets.

16 Claims, 5 Drawing Figures

BIPOLAR FOG ABATEMENT SYSTEM

This invention was made in the course of work performed under contract with the Office of Naval Research.

The invention pertains to the abatement of warm fog in a designated air space at an airport, such that aircraft can land safely. So far, only the heating method has been used for the dispersal of warm fog; however, the power requirements for this method are very large. It is the object of the present invention to provide a system of fog abatement which requires substantially less power than the heating method.

It appears that an electrical method may provide an approach for such a system. Electric fog dispersal work has been conducted by Ruhnke (1970), Gourdine (1975), and the group at Naval Weapens Center (1972, 1973, 1976); this work is also somewhat related to the electric method of dust suppression, such as described in Gourdine's U.S. Pat. No. 3,757,491, although the possibilities for implementation of electrode configurations are quite different.

The electrified drops which need to be introduced in electric fog dispersal systems may be delivered into the atmosphere by means of air jets. The proposed systems of this type employ charged drops of a single polarity, which need to be blown aloft by the air jets, and which need to get attached to fog drops in order to cause electric precipitation or dilution of the fog. These charged "seeds" must have a small mobility in order that they are not prematurely driven out of the air jets by mutual electric repulsion. On the other hand however, the drops resulting from coalescence of the fog drops and the charged seeds can, at most, acquire the same velocity as the seeds, in the combined electric and gravitational field; this is due to the Wilson velocity limit, noticed first by C. T. R. Wilson (1929), and discussed further by Whipple and Chambers (1944). As a result, the seed mobility restricts the fog clearing speed, which needs to be considerable if new fog is continuously blown in by the wind. The contradictory requirements on the mobility of the charged seeds to be blown aloft by the air jets, i.e., low mobility required to prevent that the seeds are prematurely driven out of the jet, and high mobility required for fast fog clearing, will be called the "mobility dilemma".

One may think that turbulence can provide a resolution of this dilemma. The charged seeds may be brought up to the required height above the ground by turbulent mixing, and a substantial electric field could indeed be set up in this manner, if ground corona could be avoided by some means. However, if the seeds are indeed suspended by turbulence, i.e., the seeds do not precipitate electrically, then the fog drops which have acquired an electric charge by coalescence with charged seeds do not precipitate electrically either; the same turbulence which prevents electric precipitation of the charged seeds prevents electric precipitation of the charged fog drops. It follows that turbulent mixing does not give relief of the mobility dilemma. It is the further object of the present invention to provide a resolution of the mobility dilemma.

Another problem confronting electric fog dispersal schemes which employ electrified jets is due to the corona discharge which occurs at the rough ground surface when the electric field at the ground exceeds a certain value $E_c$. It turns out that for electric fog dispersal to work, the electric field on the ground must by far exceed the value $E_c$, and that therefore ground corona would make it impossible to set up the required field. Ruhnke (1970) has proposed to surround the air jet with a polished surface in order to suppress corona discharge. It is the further object of the present invention to provide a practical and inexpensive corona guard over an extended ground area.

Usually, cross wind continuously blows new fog into the air space to be kept clear of fog. This puts very heavy demands on the performance of the fog abatement system. A great relief from such demands may be obtained by substantially diminishing the wind velocity in the spatial region to be cleared, by artificial means. It is yet another further object of the present invention to provide for a substantially cross-wind free condition in the fog treatment region.

By way of summary, the objects of the invention are achieved by introducing electrically charged drops of both polarities, i.e., jet droplets $s^+$ blown aloft by the jets, and collector drops $c^-$ emitted on the ground at a location downwind of the jet array. The jet droplets $s^+$ are given sufficiently low mobility such as to stay long enough in the jet to be blown to the required height above the ground, and the collector drops $c^-$ are given high enough mobility for fast collection of fog drops in an upward motion in the collective electric field set up by the $s^+$. Ground corona is prevented by means of a shallow basin filled with water and oil; the water-oil interface provides for the smooth conducting surface required, and the oil layer prevents evaporation of the water. The desired substantial stilling of the fog treatment region is achieved by means of a gapped jet, consisting of a linear array of air jets with spacing and momentum flux chosen in such a manner that the air flux entrained at the lee side of the jet array is substantially equal to the crosswind flux which penetrates the jet array.

The invention will be fully understood from the following detailed description and accompanying drawings, in which.

Figure 1:
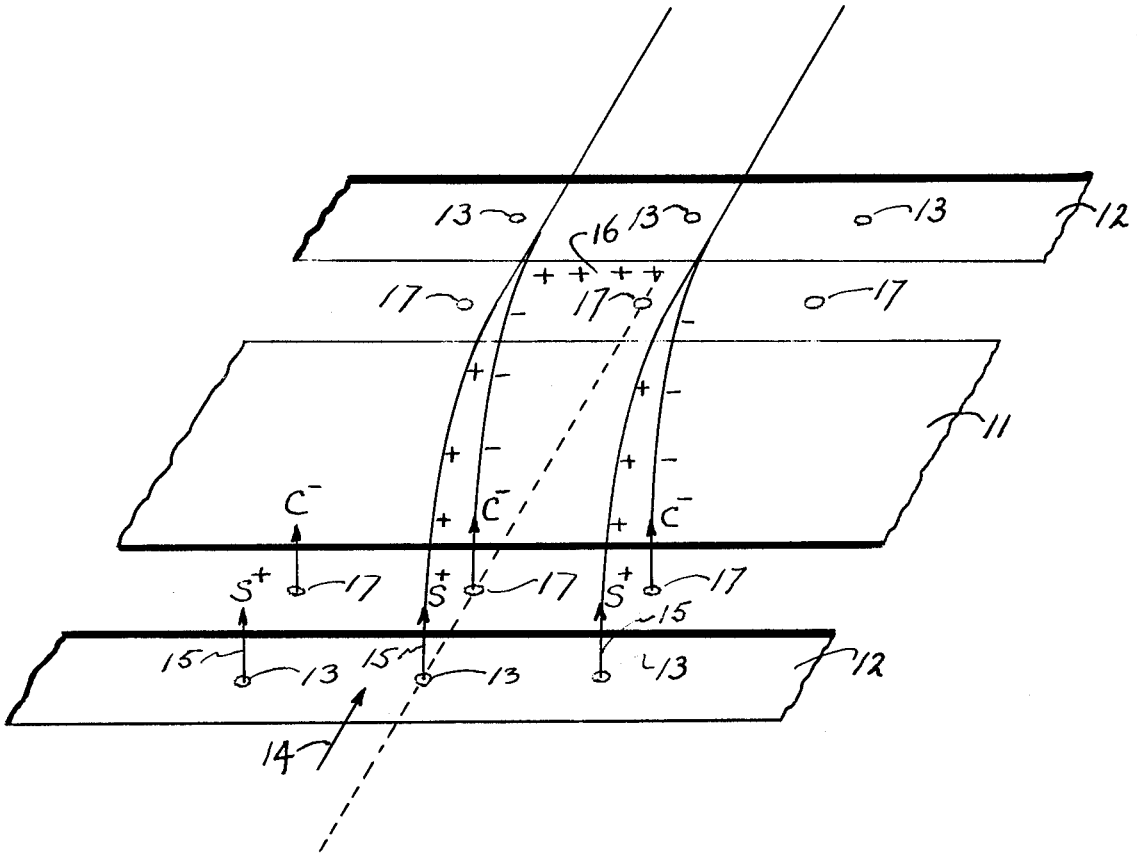
FIG. 1 shows schematically the fog abatement configuration.

Referring now to FIG. 1, the runway 11 is bordered by two shallow basins 12, which contain water and a thin layer of oil. In each basin 12 is located a linear array of nozzles 13. Let there be a crosswind component 14 relative to the runway 11. The nozzle 13 on the crosswind side of the runway emit air jets 15, laden with electrically charged water droplets $s^+$; these droplets are blown aloft by air jets 15 to form a virtual electrode 16, suspended above the air space to be cleared of fog. On each side of the runway there also is a linear array of drop dispensers 17 which emit charged collector drops $c^-$, which move upward in the electric field due to the $s^+$ in the presence of the conducting ground. The electric mobility of the $s^+$ is chosen small enough that the droplets are not prematurely driven out of the air jet by mutual repulsion.

Figure 2:
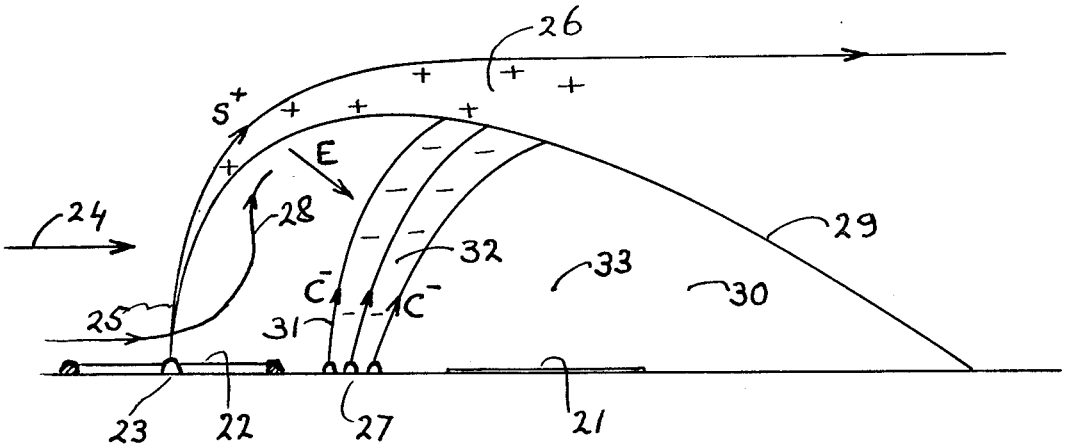
FIG. 2 shows a cross section of the system in a direction perpendicular to the runway.
Figure 3:
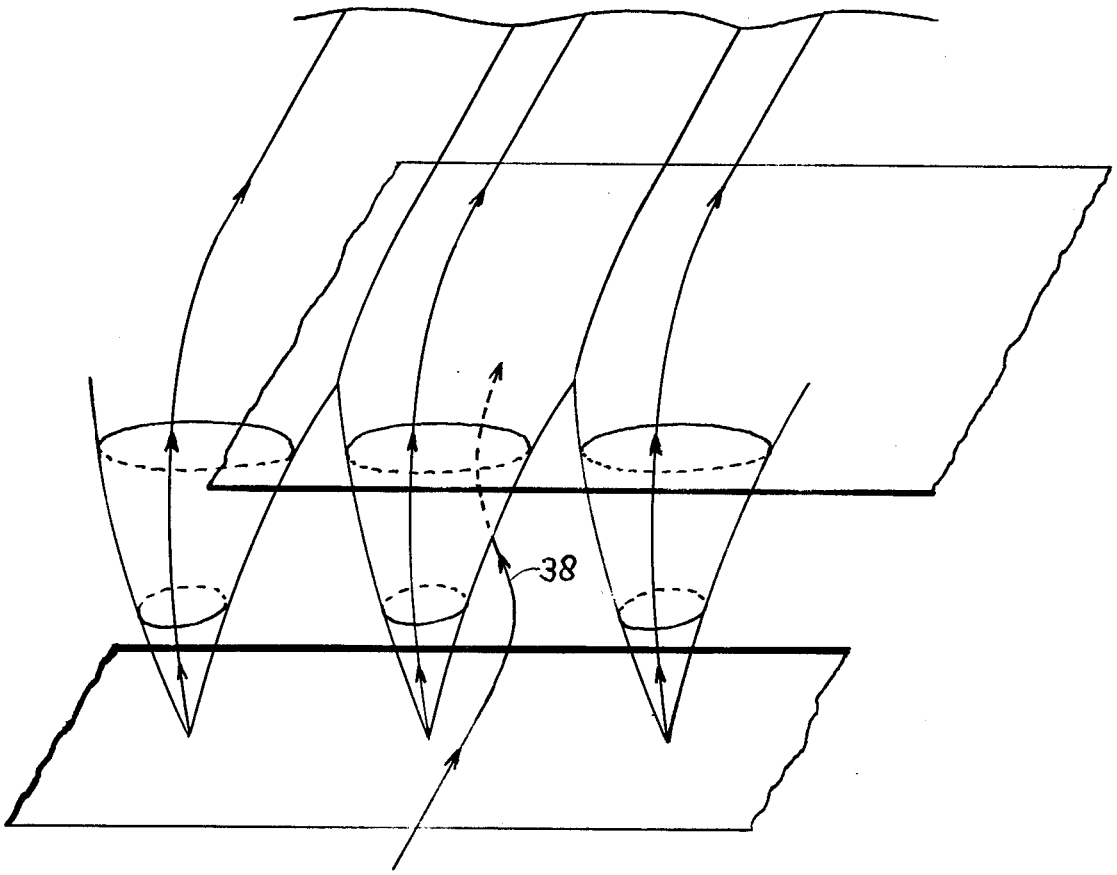
FIG. 3 depicts how the individual jets of the array spread and merge, and how the wind flux penetrating the array is entrained on the lee side of the array, by judicious choice of the jet perforation ratio.

FIG. 2 shows a cross section of the aerodynamic and electric configuration in a direction perpendicular to the runway. Shown are the runway 11, the shallow basin 12, one of the air jet nozzles 13, the crosswind component 14, one of the air jets 15, the virtual electrode 16, a cluster of drop dispensers 17, and jet droplets s+ blown aloft by the air jet 15. The figure shows how the air jet is bent over by the crosswind and by the transverse electric loading, and how the jet spreads due to turbulent diffusion and entrainment, and also due to the electric body force which results from the mutual repulsion of the s+. The collector drops c− move upward toward the virtual electrode 16, in the field of the s+, the c−, and the conducting ground, and the c− are transported as well with the small air velocity remaining at their location. This air velocity is small compared to the wind because of arrangements to be discussed presently. The turbulent jets entrain surrounding air from all sides. If the jet were two-dimensional, i.e., without gaps, the entrainment on the lee side would set up a circulatory flow underneath the jet, bent over by the wind. Analysis has shown this circulatory flow to be detrimental to fog abatement. The circulatory flow can be quenched by means of gaps in the jet, chosen in such a manner that the lee side entrainment flux is just provided by the wind flux which penetrates through the jet gaps. Shown is a streamline 38 of crosswind penetrating through the gap between adjacent jets and curving upward and inward towards the jet in the process of entrainment. This streamline is also shown in FIG. 3 as 38. The arrangement with equal fluxes of wind penetration and lee side entrainment discussed above is called "a gapped jet with balanced perforation ratio". When the condition of equality of fluxes is satisfied, the lower jet boundary 29 of FIG. 2 acts as a virtual canopy, shielding the "cavity" 30 underneath the virtual canopy substantially from the wind, and even quenching the circulatory flow which develops behind a partial material windshield, as in the case of a convertible automobile with the top down. Hence, the gapped jet with balanced perforation ratio causes the air in the fog treatment space to be substantially still. This results in rather steep initial trajectories 31 of the collector drops c− emitted by the drop dispensers 17. There will be a small residual velocity of air flowing through the spatial region 32 which is being traversed by the fast moving collectors c−. At the upstream end of region 32 the air is laden with fog drops. Conditions can be arranged such that the probability for capture of a fog drop by one of the collectors c−, as the fog drop moves through region 32, is close to unity. Then nearly all the fog drops moving through region 32 coalesce with one or more c−, i.e., these fog drops acquire a charge, and they are moved upward by the electric field. Analysis shows that parameters can be chosen such that this upward motion and removal of the charged fog drops occurs fast enough to leave a substantial region 33 with large enough visibility to make visual aircraft landings possible. Outside fog diffuses through the jet by turbulent diffusion, and therefore the surface of marginal visibility curves downward towards the ground, past the runway, as shown. The electric field E set up by the s+, the c−, and by their images in the ground exerts a body force on the jet which adds to the jet curvature due to the crosswind. In the region where the s+ and the c− meet there is neutralization of the charges of opposite polarity, so that downstream of this region the jet is substantially neutral, and there is no electric loading.

Figure 4:
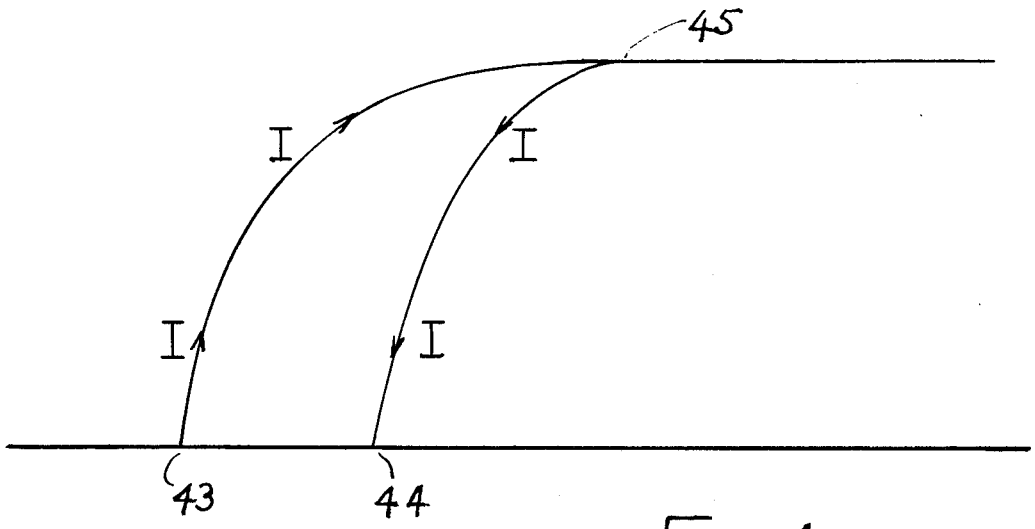
FIG. 4 depicts the configuration of electric currents.

FIG. 4 shows schematically the electric current path due to the motion of the fog droplets s+ *and the collector drops* c−. The s+ are emitted by the jet at 43, and the c− are emitted by the drop dispenser at 44. The electric current I flows as shown; at the cusp 45 the neutralization of s+ and c− takes place. In the description given above, the jet drops have a positive electric charge, and the collector drops have a negative charge. The opposite choice of polarities is possible also, and the choice in practice will depend on convenience and the differences between postitive and negative coronas.

In addition to the crosswind effects discussed above, one must account for the component of the wind parallel to the runway. Such a wind component will increase the turbulent diffusion of fresh fog through the top of the canopy, and it will slant streamlines in the direction of the runway. Neither effect is expected to affect the feasibility of the present fog abatement system.

Figure 5:
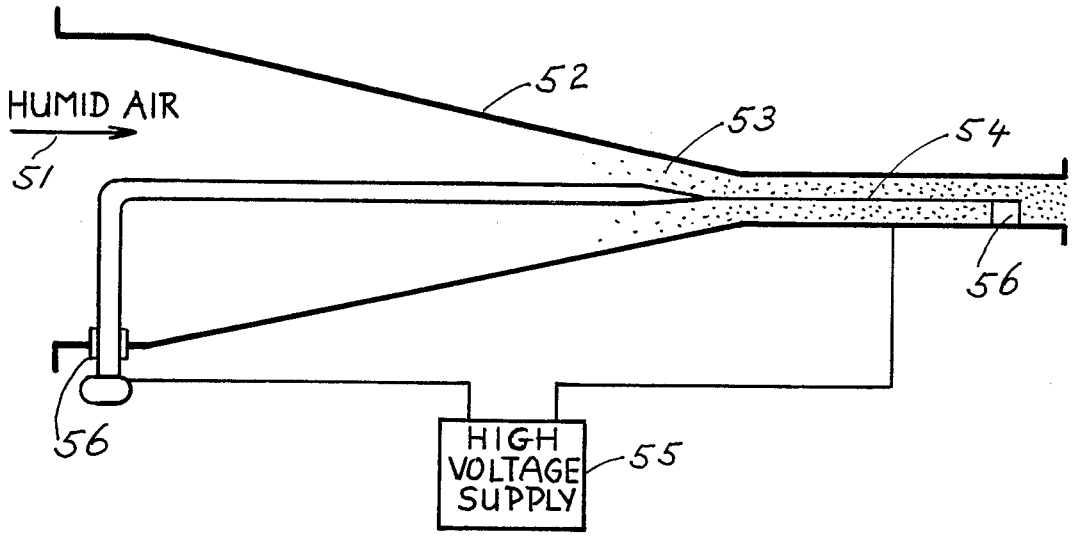
FIG. 5 shows schematically a nozzle for emission of an air jet laden with electrically charged drops.

The nozzles 13 which emit air jets 15 laden with electically charged drops s+ can be constructed in a manner known to those skilled in the art, as follows. Referring to FIG. 5, humid compressed air 51 laden with an appropriate concentration of aerosol of appropriate size and constitution is expanded through a nozzle 52 causes a condensation of water vapor on the aerosol, resulting in the formation of doplets 53 in the flowing air. The droplets are electrically charged by means of a corona discharge from a corona wire 54 connected to a high-voltage supply 55; the corona wire assembly is insulated from the nozzle by insulators 56. A spray gun of a similar type, developed at Gourdine Systems, Inc. has been described by Chiang et al (1973).

The drop dispensers which are to emit the charged collector drops c− can be of similar construction as the nozzle described above, albeit with a much reduced air flow, but it is also possible to build a drop dispenser by producing the collector drops with a high-pressure spray and by charging the drops inductively, as described, for instance, by Ruhnke (1970), and by Carroz and Keller (1976).

The gapped jet with balanced perforation ratio has independent merit as a device to reduce air velocity in other methods of fog abatement, such as the heating method.

A shallow basin containing water and oil may be used wherever a corona guard on a horizontal surface is required. There is a threshold value for the electric field above which a Rayleigh instability of the water-oil surface occurs, which causes highly charged water drops to break away from the interface, move upward through the oil, and emerge into the air. The threshold field may be calculated from theory. A preliminary test using a ¼" layer of SAE 30 motor oil on water showed on instabilities for electric fields up to $6\times10^5$ V/m, about the largest field under consideration for the present method of electric fog abatement.

The gapped jet with balanced perforation ratio may in first approximation be designed from the following consideration. The entrainment volume flux on the lee side of a two-dimensional turbulent air jet, per unit of time and span, is $$F(s)=0.31\sqrt{Ks}, \quad (1)$$

where K is the kinematic jet momentum flux per unit time and span, and s is the flow distance along the jet centerline. Let the gaps in the jet array be such that a wind flux $\omega h U_0$ penetrates the jet; $\omega$ is a coefficient to be determined, h is the height to which the jet rises, and $U_0$ is the wind velocity, here assumed independent of height. In order that the penetrating wind flux precisely provides for the lee entrainment, one must have $$\omega h U_0 = 0.31\sqrt{Ks}; \quad (2)$$

in (2), s is the arc length along the jet to a point where entrainment ceases. For order-of-magnitude purposes, this s is taken such that the half width of the jet at half velocity equals the jet height h, $$h = 0.115s, \quad (3)$$

where use has been made of the Tollmien theory of turbulent plane jets (see Schlichting (1968)). For the gapped jet with perforation ratio $\omega$, the inviscid model gives, from momentum conservation in the direction of the crosswind, $$K = h(1-\omega^2)U_0^2. \quad (4)$$

Consistency of (2), (3), and (4) requires $$\omega = 0.7; \quad (5)$$

as a consequence, (4) gives $$K = 0.5hU_0^2. \quad (6)$$

(6) gives an approximate value for the kinematic momentum flux per unit of time and span which is needed in order that the gapped jet rises to a height h above the ground, in a crosswind with velocity $U_0$. (5) gives an approximate value for the perforation ratio of the gapped jet, needed for balancing of the lee entrainment flux and the wind penetration flux.

The condition of low mobility for the electrically charged droplets blown aloft by the air jets may be stipulated as follows. Let $E_0$ be the maximum electric field due to the jet droplets s+ blown aloft by the jets. For the electric current I carried by the jet array per unit span (span is in the direction of the array) one has approximately $$I = \epsilon E_0 U_0, \quad (7)$$

where $\epsilon$ is the dielectric constant of air. Let $\theta$ be the slope of the half-velocity line in the jet, with respect to the center line, and let $\Delta\theta$ be the ratio of the transverse electric velocity of the s+ at the outer edge of the jet, and the crosswise-average jet velocity. From the Tollmien theory, (6), (7), and electrical considerations one finds, for small $\Delta\theta$, $$\frac{\Delta\theta}{\theta} = 3.4\frac{k_s E_0}{U_0}, \quad (8)$$

where $k_s$ is the electric mobility of the s+. In order that the s+ are not prematurely driven out of the jets one must have $$\frac{\Delta\theta}{\theta}$$

small compared with unity. For $$\frac{\Delta\theta}{\theta} < 0.1$$

one has from (8)

$$\frac{k_s E_0}{U_0} < 2.9 \times 10^2 \quad (9)$$

as the condition for "low mobilty".

The collector drops c− emitted by the drop dispensers 27 are subject to the electric field due to the s+, the c−, and their ground images. If the s+ and c− currents are equal, the electric field at the most crosswind-downstream c− position is relatively small, because of the screening by the c− in more upstream locations. A large electric field, even at the most downstream c− position, is desired in order that the c− have steep trajectories. Therefore, it is desirable to apply a booster field, and this can be done simply by making the electric current carried by the s+ substantially larger than the current carried by the c−. Then, at the cusp 45 there will not be complete neutralization, and a substantial space charge will be carried off from the cusp region by the wind and the jet. As a rough guide, the s+ current can be chosen as about twice the c− current.

If an electric field in excess of $E_c$ would exist on the ground at the location of the collector drop dispenser, the water-and-oil basin should be extended to cover this location.

The condition of high mobility of the electrically charged collector drops may be stipulated as follows. The c− mobility should be large enough that the c− trajectories are sufficiently steep to provide an adequate airspace cleared of fog. Let $U_c$ and $E_{col}$ be respectively the horizontal air velocity and the electric field, averaged across the c− trajectories, at a height of ½h above the ground. $U_c$ is much smaller than the wind velocity $U_0$, because of the shielding effect of the gapped jet with balanced perforation ratio. The average slope of the c− trajectories will be judged adequate in this context if $$\frac{k_c E_{col}}{U_c} > 2, \quad (10)$$

where $k_c$ is the electric mobility of the c−. (10) is taken as the condition for "high mobility".

Although for efficiency it is best to have all s+ of one polarity, it is possible to have a system in which the jet droplets have electric charges of both polarities, and similarly, to have collector drops with electric charges of both polarities, as long as the predominant polarity of the jet droplets is different from the predominant polarity of the collector drops. In the above, "predominant polarity" is defined as the sign of the average electric charge.

The gapped jet is described above as a linear array of jets emitted from nozzles, which may be taken as axisymmetric. Alternately, the nozzles may have the shape of rectangular slots. The gapped jet may then seen as a jet emited from a long slot, which is periodically blocked.

In the above, an airport is taken to be the site at which the fog abatement system is applied. The system may be applied as well to an aircraft carrier, or a roadway, an oil drilling platform, a sea going vessel or platform, or any other structure or site where the visibility must be maintained above a certain level.

This invention is not to be limited by the embodiments shown in the drawings and described in the description, which are given by way of example and not of limitation, but only in accordance with the scope of the appended claims.

What is claimed is:

1. A method for abatement of fog in a predetermined spatial region, subject to wind, comprising:

distributing a set of nozzles which are aimed in a substantially upward direction in such a manner that said nozzles are spaced apart from each other and occupy at least an area on one side of the clearing volume, the latter being the predetermined spatial region subject to wind, and bordering on the ground, which is to be cleared of fog;

emitting, for each nozzle of said set of nozzles, an airjet laden with electrically charged droplets with a predominant polarity and a low mobility, said low mobility being sufficiently small that the charged droplets are essentially not driven out of the said airjet by electric repulsion up to the height of the upper boundary of said clearing volume, and such that said charged droplets, blown aloft by each said airjet of the said set of nozzles and moved downstream by said wind, collectively forms a virtual electrode which is substantially suspended above the said clearing volume;

dispensing electrically charged drops of high mobility, called collector drops, with a polarity opposite to said predominant polarity, in locations spaced apart from each other in an area at least on one side of said clearing volume, but placed away from the said set of nozzles;

moving said collector drops along trajectories which are directed substantially upward toward said virtual electrode by action of the collective electric field set up by the said virtual electrode, the electric charges in each said airjet, the electric charges on said collector drops, and the polarization charges on said ground which come about in response to the charges introduced;

causing the said collector drops, moving along their said trajectories in a substantially upward motion, to collide with neutral fog drops in their paths, thereby causing coalescence of said collector drops and fog drops, resulting in disappearance of fog drops and enlargement of said collector drops;

eventually causing both the original collector drops and the collector drops which have been enlarged by said coalescence with fog drops to move towards the upper boundary of the said clearing volume, by action of said collective electric field on the electric charge of the collector drops; and causing substantial clearing of the said clearing volume by removal of most of the fog drops blown in by said wind, by the mechanism of said coalescence of last said fog drops with collector drops, said high mobility being sufficiently large to cause said trajectories to be steep enough to remain essentially outside of the said clearing volume.

2. A method according to claim 1, further including the step of placing a basin filled with at least one liquid around the said nozzles, for the purpose of preventing the occurrence of a ground corona discharge due to said collective field.

3. A method according to claim 1, in which said set of nozzles is distributed in the configuration of at least one row of nozzles, giving rise to a gapped air jet, and further including the steps of causing a balance between the wind flux penetrating said gapped air jet up to the height of said clearing volume and the air entrained on the lee side of said gapped air jet;

causing substantial reduction of the air velocity due to wind in the said clearing volume, as a result of said balance;

causing a steepening of said trajectories as a result of said reduction of the air velocity due to wind in the said clearing volume; and causing improved fog clearance in the said clearing volume, as a result of said steepening.

4. A method according to claim 3, further including the step of placing a basin filled with at least one liquid around said nozzles, for the purpose of preventing the occurrence of a ground corona discharge due to said collective electric field.

5. A method for abatement of fog in a predetermined spatial region, subject to wind, comprising:

distributing a set of nozzles which are aimed in a substantially upward direction, in such a manner that the nozzles in said set of nozzles are spaced apart from each other and occupy at least an area on one side of the clearing volume, the latter being the predetermined spatial region subject to wind, and bordering on the ground, which is to be cleared of fog;

generating, for each said nozzle, a flow of humid compressed air, said air being laden with aerosol;

expanding said flow through said nozzle such as to cause condensation of water vapor present on said aerosol, resulting in the formation of water droplets in the flowing air, and such as to produce an airjet which emerges from said nozzle;

subjecting the said flowing air to a corona discharge such that said water droplets acquire an electric charge with a certain predominant polarity and a low mobility, said low mobility being sufficiently small that the charged water drops are essentially not driven out of the said airjet by mutual electric repulsion up to the height of the upper boundary of said clearing volume, and such that the said charged water drops blown aloft by each said airjet of the said set of nozzles, and moved downstream by the wind, collectively form a virtual electrode which is substantially suspended above said clearing volume;

dispensing electrically charged drops of high mobility, called collector drops; with a polarity opposite to said predominant polarity, in locations spaced apart from each other in an area at least along one side of the said clearing volume, but placed away from the said set of nozzles;

moving said collector drops along trajectories which are directed substantially upward toward said virtual electrode by action of the collective electric field set up by the said virtual electrode, the electric charges in each said airjet, the electric charges on said collector drops, and the polarization charges on said ground which come about in response to the charges introduced;

causing the said collector drops, moving along their said trajectories in a substantially upward motion, to collide with neutral fog drops in their paths, thereby causing coalescence of said collector drops and fog drops, resulting in disappearance of fog drops and enlargement of said collector drops;

eventually causing both the original collector drops and the collector drops which have been enlarged by said coalescence with fog drops to move towards the upper boundary of the said clearing volume, by action of said collective electric field on the electric charge of the collector drops; and causing substantial clearing of the said clearing volume by removal of most of the fog drops blown in by said wind, by the mechanism of said coalescence of last said fog drops with collector drops, said high mobility being sufficiently large to cause said trajectories to be steep enough to remain essentially outside of the said clearing volume.

6. A method according to claim 5, further including the step of placing a basin filled with at least one liquid around the said nozzles, for the purpose of preventing the occurrence of a ground corona discharge due to said collective electric field.

7. A method according to claim 5, in which said set of nozzles is distributed in the configuration of at least one row of nozzles, giving rise to a gapped air jet, and further including the steps of causing a balance between the wind flux penetrating said gapped air jet up to the height of said clearing volume and the air entrained on the lee side of said gapped air jet;

causing a substantial reduction of the air velocity, due to wind, in the said clearing volume, as a result of said balance;

causing a steepening of said trajectories as a reult of said reduction of the air velocity, due to wind, in the said clearing volume; and causing improved fog clearance in the said clearing volume, as a result of said steepening.

8. A method according to claim 7, further including the step of placing a basin filled with at least one liquid around said nozzles, for the purpose of preventing the occurrence of a ground corona discharge due to said collective electric field.

9. A system for abatement of fog in a predetermined spatial region, subject to wind, comprising:

a set of nozzles which are aimed in a substantially upward direction and which are distributed in such a manner that said nozzles are spaced apart from each other and occupy at least an area on one side of the clearing volume, the latter being the predetermined spatial region to be cleared of fog, said spatial region being subject to wind, and bordering on the ground;

means for emitting, from each nozzle of said set of nozzles, an air jet laden with electrically charged droplets with a predominant polarity and a low mobility, said low mobility being sufficiently small that the charged droplets are essentially not driven out of the said air jet by electric repulsion up to the height of the upper boundary of said clearing volume, and such that said charged droplets blown aloft by each said air jet of the said set of nozzles and moved downstream by the wind, collectively form a virtual electrode which is substantially suspended above the said clearing volume;

means for dispensing electrically charged drops, called collector drops, with a polarity opposite to said predominant polarity, in locations spaced apart from each other in an area at least on one side of said clearing volume, but placed away from said set of nozzles;

means for moving said collector drops along trajectories which are directed substantially upward by the action of the collective electric field of all the charges present, such that the said collector drops collide with fog drops in their paths, thereby coalescing with last said fog drops, and removing them from the wind flow into the said clearing volume;

means to cause the said collector drops to have a sufficiently high mobility, such that the said trajectories are steep enough to remain essentially outside the said clearing volume, thereby providing efficient removal of fog drops blown in by said wind, by the mechanism of coalescence with the said collector drops, and thereby causing the said clearing volume to be substantially clear of fog.

10. A system according to claim 9, further including a basin filled with at least one liquid around the said nozzles, for the purpose of preventing the occurrence of a ground corona discharge due to said collective electric field.

11. A system according to claim 9, in which said set of nozzles is distributed in the configuration of at least one row of nozzles, giving rise to a gapped air jet, and further including:

means for causing a balance between the wind flux penetrating said gapped air jet up to the height of said clearing volume and the air entrained on the lee side of said gapped air jet, resulting in a substantial reduction of the air velocity due to wind in the said clearing volume, and thereby steepening the said trajectories such as to cause improved fog clearance in the said clearing volume.

12. A system according to claim 11, further including a basin filled with at least one liquid around the said nozzles, for the purpose of preventing the occurrence of a ground corona discharge due to said collective electric field.

13. A system for abatement of fog in a predetermined spatial region, subject to wind, comprising:

a set of nozzles, said nozzles being aimed in a substantially upward direction, and being spaced apart from each other in an area located on at least one side of the clearing volume, the latter being the predetermined spatial region to be cleared of fog, said spatial region being subject to wind, and bordering on the ground;

means for generating, for each of the said nozzles, a flow of humid compressed air, said air being laden with aerosol;

means for expanding said flow through each of the said nozzles such as to cause condensation of water vapor present on said aerosol, resulting in the formation of water droplets in the flowing air, and such as to produce an air jet which emerges from each of said nozzles;

means for subjecting the said flowing air to a corona discharge such that said water droplets acquire an electric charge with a certain predominant polarity and a low mobility, said low mobility being sufficiently small that the charged water drops are essentially not driven out of the said air jet by mutual electric repulsion up to the height of the upper boundary of said clearing volume, and such that the charged water drops blown aloft by each said air jet of the said set of nozzles, and moved downstream by the wind, collectively form a virtual electrode which is substantially suspended above the said clearing volume;

means for dispensing electrically charged drops of high mobility, called collector drops, with a polarity opposite to said predominant polarity, in locations spaced apart from each other in an area situated at least along one side of the said clearing volume, but placed away from the said set of nozzles;

means for moving said collector drops along trajectories which are directed substantially upward by the action of the collective electric field of all the charges present, such that the said collector drops collide with fog drops in their paths, thereby coalescing with last said fog drops, and removing them from the wind flow into the said clearing volume;

means to cause the said collector drops to have sufficiently high mobility, such that the said trajectories are steep enough to remain essentially outside the said clearing volume, thereby providing efficient removal of fog drops blown in by said wind, by the mechanism of coalescence with the said collector drops, and thereby causing the said clearing volume to be substantially clear of fog.

14. A system according to claim 13, further including a basin around said nozzles, said basin containing at least one liquid, for the purpose of preventing the occurrence of a groung corona discharge due to said collective electric field.

15. A system according to claim 13, in which said set of nozzles is distributed in the configuration of at least one row of nozzles, giving rise to a gapped air jet, and further including:

means for causing a balance between the wind flux penetrating said gapped air jet up to the height of said clearing volume and the air entrained on the lee side of the said gapped air jet, resulting in a substantial reduction of the air velocity due to wind in the said clearing volume, and thereby steepening the said trajectories such as to cause improved fog clearing in the said clearing volume.

16. A system according to claim 15, further including a basin around said nozzles, said basin containing at least one liquid, for the purpose of preventing the occurrence of a ground corona discharge due to said collective electric field.

* * * * *